US006345694B1

(12) United States Patent
Volker

(10) Patent No.: US 6,345,694 B1
(45) Date of Patent: Feb. 12, 2002

(54) INDUSTRIAL TRUCK WITH ELEVATABLE DRIVER'S PLATFORM AND METHOD FOR THE OPERATION THEREOF

(75) Inventor: Haspel Volker, Reutlingen (DE)

(73) Assignee: Still Wagner GmbH & Co. KG (DE)

( * ) Notice: Subject to any disclaimer, the term of this patent is extended or adjusted under 35 U.S.C. 154(b) by 0 days.

(21) Appl. No.: 09/382,076

(22) Filed: Aug. 24, 1999

(30) Foreign Application Priority Data

Aug. 28, 1998 (DE) ..... 198 39 234

(51) Int. Cl.[7] ..... B66F 9/20
(52) U.S. Cl. ..... 187/223; 187/222; 187/200
(58) Field of Search ..... 187/200, 202, 187/222, 223, 224, 240, 244, 231; 182/148; 180/89.13; 244/137.2

(56) References Cited

U.S. PATENT DOCUMENTS

| | | | | |
|---|---|---|---|---|
| 4,176,732 A | * | 12/1979 | Nordskog | 187/200 X |
| 4,679,645 A | * | 7/1987 | Galloway et al. | 187/223 X |
| 5,044,472 A | | 9/1991 | Dammeyer et al. | 187/9 R |
| 5,203,425 A | | 4/1993 | Wehmeyer | 182/19 |
| 5,499,694 A | * | 3/1996 | Dorn | 187/200 |
| 5,740,887 A | * | 4/1998 | Unger et al. | 187/231 |
| 6,000,502 A | * | 12/1999 | Leasor et al. | 187/222 |
| 6,182,798 B1 | * | 2/2001 | Brady et al. | 187/200 X |

FOREIGN PATENT DOCUMENTS

| | | | |
|---|---|---|---|
| DE | 2347974 | 4/1974 | |
| DE | 2313364 | 9/1974 | |
| DE | 19518116 A1 | 11/1995 | B66F/9/07 |
| FR | 2440334 | 5/1980 | B66F/17/00 |
| GB | 2289669 | 11/1995 | B66F/9/075 |
| WO | WO9809910 | 3/1998 | B66F/9/06 |

OTHER PUBLICATIONS

VDI/AWF 2361 Disclosure, Aug. 1969.

* cited by examiner

*Primary Examiner*—Eileen D. Lillis
*Assistant Examiner*—Thuy V. Tran
(74) *Attorney, Agent, or Firm*—Webb Ziesenheim Logsdon Orkin & Hanson, P.C.

(57) ABSTRACT

An industrial truck with a forward propulsion unit for horizontal movement of the industrial truck, a driver's platform that can be raised or lowered by a vertical propulsion unit, at least one control device to control the vertical propulsion unit and the forward propulsion unit, and at least one blocking device that can be adjusted as necessary to close or open an entrance to the driver's platform. The control device is switched so that, depending on the level of the driver's platform and the position of the blocking device, either all the functions of the forward propulsion unit and of the vertical propulsion unit are enabled, or all the functions of the forward propulsion unit and of the vertical propulsion unit are disabled, or a raising of the driver's platform is disabled, while a lowering of the driver's platform and/or a horizontal movement of the industrial truck is possible. The control device is advantageously switched so that during a raising of the driver's platform with an open blocking device, as soon as a specified height is reached, any further raising of the driver's platform is prevented, although a lowering of the driver's platform and/or a horizontal movement of the industrial truck are still possible.

5 Claims, 1 Drawing Sheet

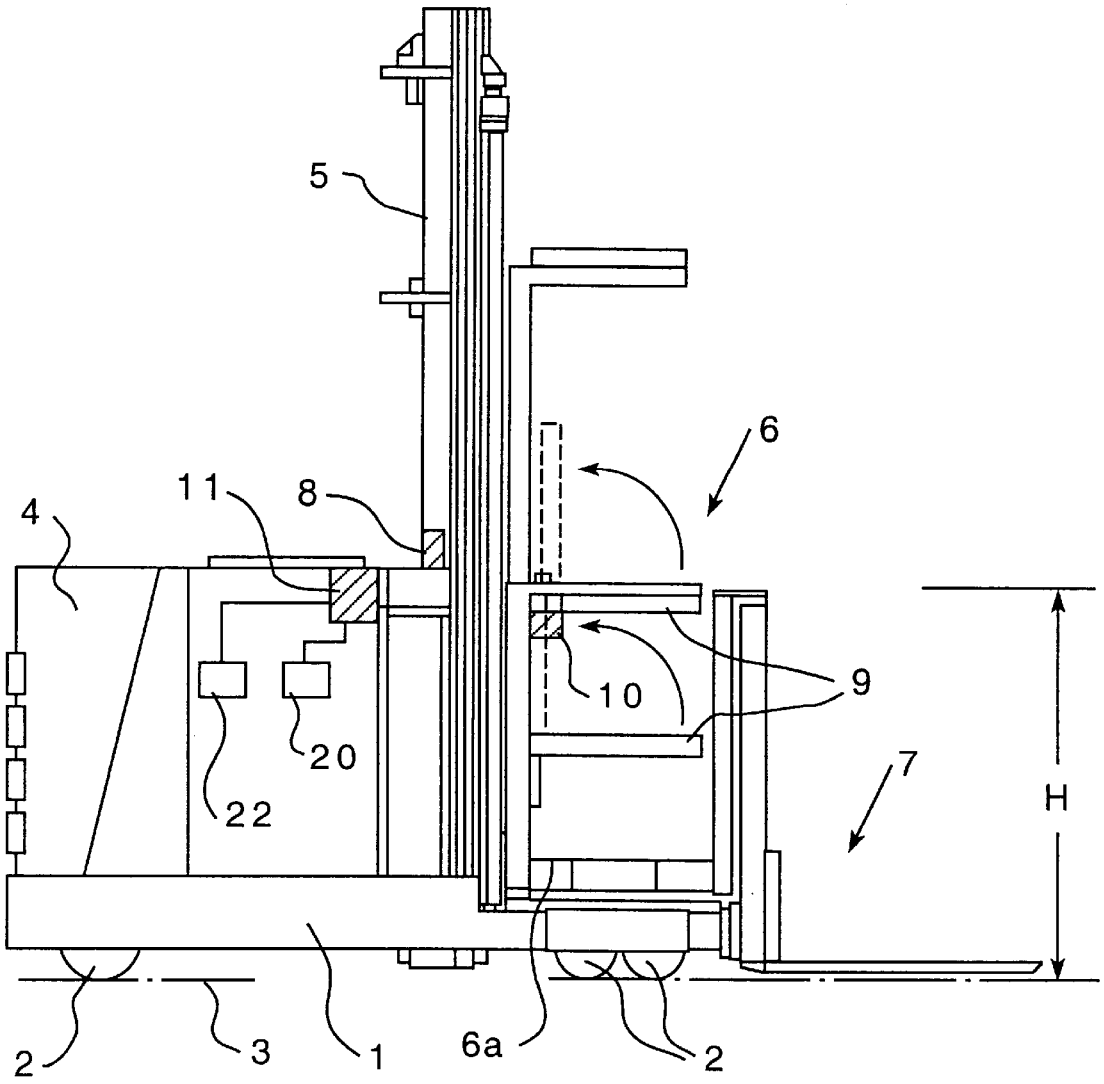
5
6
11
8
4
9
10
20
22
7
H
2
3
1
6a
2

INDUSTRIAL TRUCK WITH ELEVATABLE DRIVER'S PLATFORM AND METHOD FOR THE OPERATION THEREOF

BACKGROUND OF THE INVENTION

1. Field of the Invention

This invention relates generally to an industrial truck having a forward propulsion unit for horizontal movement of the industrial truck, a driver's platform that can be raised or lowered by means of a vertical propulsion unit, at least one control device to control the vertical propulsion unit and the forward propulsion unit, and a blocking device that can be adjusted as desired to block or allow access to the driver's platform. The invention also relates to a method for the operation of an industrial truck having a forward propulsion unit for horizontal movement of the industrial truck, a driver's platform that can be raised or lowered by means of a vertical propulsion unit, at least one control device to control the vertical propulsion unit and the forward propulsion unit, and a blocking device that can be adjusted as desired to block or allow access to the driver's platform in which a first signal transmitter is effectively connected with the control device, the output signal of which first signal transmitter changes as a function of a position of the driver's platform below or above a specified elevation, and in which a second signal transmitter is effectively connected with the control device, the output signal of which second signal transmitter changes as a function of the position of the blocking device.

2. Description of the Currently Available Technology

Industrial trucks with an elevatable driver's platform are typically equipped with a blocking device by means of which the access to the driver's platform can be blocked. Such a blocking device is generally required on all industrial trucks on which the driver's platform can be raised above a specified elevation, such as about 1.2 meters. The blocking device is frequently embodied as a gate that can be moved manually by the driver. A signal transmitter located on or near the gate determines the position of the gate and generates a signal that indicates whether the gate is open or closed. Industrial trucks may also be equipped with a signal transmitter for elevation that indicates whether the driver's platform is elevated above the specified height.

To maintain compliance with occupational safety regulations, it is conventional to connect the signal transmitters for elevation and the status of the blocking device with an emergency off function of the industrial truck. The forward propulsion unit and the vertical propulsion unit are automatically deactivated if the driver's platform has been elevated at least to the specified height and the blocking device is simultaneously open. This conventional device frequently results in an unintentional deactivation or shutdown of the industrial truck, in particular if, during an elevation of the driver's platform, the specified height is reached while the gate is open.

An object of the invention is therefore to provide an industrial truck of the type described above as well as a method for the operation of the industrial truck in which, while complying with conventional safety requirements, an unintentional shutdown of the entire industrial truck can be prevented.

SUMMARY OF THE INVENTION

To accomplish this object, the invention teaches that an industrial truck control device is designed so that, as a function of the elevation of the driver's platform and the position of the blocking device, either all the functions of the forward propulsion unit and of the vertical propulsion unit are enabled; or all the functions of the forward propulsion unit and of the vertical propulsion unit are disabled; or an elevation of the driver's platform is disabled, although the driver's platform can be lowered and/or the industrial truck can be moved horizontally. Depending on the operating status of the industrial truck, therefore, certain functions of the industrial truck are disabled by the control device if the driver's platform has been elevated above the specified height.

For this purpose, it is particularly advantageous if the control device is designed so that if the blocking device is open during the elevation of the driver's platform, as soon as a specified height is reached, any further elevation of the driver's platform is prevented, although the driver's platform can still be lowered and/or the industrial truck can be moved horizontally, e.g., driven normally. The control device makes it impossible to elevate the driver's platform beyond the specified height while the blocking device is open. When this specified elevation is reached, however, the industrial truck can still be driven normally and the driver's platform can be lowered.

The control device is further designed so that, after an opening of the blocking device, if the driver's platform is above the specified elevation, any vertical movement of the driver's platform as well as a horizontal movement, e.g., forward or reverse movement, of the industrial truck is prevented. The vertical propulsion unit and the forward propulsion unit are therefore kept completely stationary as long as the driver's platform is above the specified level and the blocking device is opened.

The invention teaches that it is appropriate if there is a first signal transmitter that is effectively, e.g., operationally, connected with the control device, whereby the output signal from the first signal transmitter changes as a function of a position of the driver's platform above or below the specified elevation. A first signal transmitter that has two switched positions for the output signal can be used.

There is preferably also a second signal transmitter that is effectively, e.g., operationally, connected with the control device, whereby the output signal of this second signal transmitter changes as a function of the position of the blocking device. Here again, a signal transmitter that has two switched positions for the output signal can be used, whereby the second signal transmitter assumes a first switched position when the blocking device is in the open position and a second switched position when the blocking device is in the closed position.

It is particularly advantageous if the control device is designed so that if the output signal of one of the two signal transmitters is switched over, the control device automatically verifies the control signal of the other signal transmitter. If the control device records the switchover of one of the two signal transmitters, there is an automatic verification of the status of the other signal transmitter. Depending on the output signals of the two signal transmitters, the functions of the forward propulsion unit and some or all of the functions of the vertical propulsion unit are enabled or disabled.

With regard to the method, the invention teaches that after a switchover of the output signal of one of the two signal transmitters, the control device automatically performs a verification of the control signal of the other signal transmitter, and then either enables all the functions of the forward propulsion unit and of the vertical propulsion unit;

or disables all the functions of the forward propulsion unit and of the vertical propulsion unit; or an elevation of the driver's platform is disabled, although the driver's platform can be lowered and/or the industrial truck can be moved horizontally, i.e., driven forward or backward.

BRIEF DESCRIPTION OF THE DRAWING

Additional advantages and details of the invention are explained in greater detail with reference to the exemplary embodiment illustrated in the accompanying schematic drawing FIGURE.

The accompanying drawing shows a side view of an industrial truck as used in a high-shelf warehouse. The invention can also be used, however, on other types of industrial trucks with elevatable driver's platforms, such as fork-lift trucks for use in high-shelf warehouses.

DESCRIPTION OF THE PREFERRED EMBODIMENTS

In the following discussion, the terms "above," "below," "forward," "backward," "up," "down" and other directional terms shall relate to the invention as it is oriented in the drawing FIGURE. However, it is to be understood that the invention may assume various alternative orientations. Hence, such directional terms should not be considered as limiting.

The exemplary industrial truck shown in the FIGURE has a non-elevatable frame 1 having wheels 2 configured to ride on a roadway 3, such as a warehouse floor. Located on the frame 1 is a drive housing 4, in which are located, among other things, a forward propulsion unit 20 and a vertical propulsion unit 22. Also fastened to the frame is an elevator device 5 that can be extended upwardly, i.e., away from the frame 1. By means of the vertical propulsion unit 22, a driver's platform 6 fastened to the elevator device 5 can be raised jointly with a load holding device 7 that is fastened to the driver's platform 6.

Located in the vicinity of the elevator device 5 is a signal transmitter 8, the output signal of which changes, e.g., switches, as a function of the elevation of the driver's platform 6. The signal transmitter supplies a first output signal when a base surface 6*a* of the driver's platform 6 is below a specified elevation H with respect to the roadway 3 or the frame 1. When the base surface 6*a* is at or above the specified height H, the signal transmitter 8 supplies a modified output signal. In this exemplary embodiment, the specified height H is about 1.2 meters, which is the level specified by many applicable safety requirements.

In the vicinity of the entrance to the driver's platform 6, there is a blocking device 9 which, in the exemplary embodiment illustrated, is realized in the form of two gates that are arranged one above the other. In the illustrated position of the gates, access to the driver's platform 6 is blocked. The gates are coupled with each other and can be pivoted together into the position illustrated by dotted lines, in which the entrance to the driver's platform 6 is open. The status of the blocking device, in this exemplary embodiment the position of the gates, is determined by a signal transmitter 10 that supplies an output signal which signals whether the gate is open or closed.

The two signal transmitters 8, 10 are operationally connected with a control device 11, by means of which the function of the forward propulsion unit 20 and of the vertical forward propulsion unit 22 can be controlled. When the output signal of one of the two signal transmitters 8, 10 changes, e.g., switches from one switched position to another switched position, the control device 11 performs a comparison with the output signal of the other signal transmitter 10, 8 and then controls the available functions of the forward propulsion unit 20 and of the vertical propulsion unit 22 according to the following rules:

a) In the event of a signal change of the signal transmitter 10 as the result of an opening of the blocking device 9, the status of the signal transmitter 8 for the elevation is polled:
   - If the level of the platform is below the specified level H, there is no restriction of the function of the forward or vertical propulsion units.
   - If the level of the platform is above the specified level H, the functions of the forward propulsion unit 20, e.g., moving forward or backward and the vertical propulsion unit 22, e.g., raising and lowering the platform 6, are disabled.

b) In the event of a change in the signal of the signal transmitter 10 as a result of a closing of the blocking device 9, all the functions (moving forward or backward, raising or lowering the platform) are enabled. In this case, there is no need to poll the signal transmitter 8.

c) In the event of a change in the signal of the signal transmitter 8 when the driver's platform 6 is being raised to the specified level H, the status of the signal transmitter 10 of the blocking device 9 is polled:
   - If the blocking device 9 is closed, there is no restriction of the truck functions.
   - If the blocking device 9 is open, the "raise" function of the vertical propulsion unit 22 is disabled, although the "lower" and "forward" functions remain enabled to allow the truck to be driven normally and to also allow the platform to be lowered.

d) In the event of a change in the signal of the signal transmitter 8 during a lowering of the driver's platform 6 below the specified level H, all the functions (forward, raise, lower) are enabled. In this case, there is no need to poll the signal transmitter 10.

The status set according to these rules by the control device 11 remains in effect until there is a further change in the signal of one of the signal transmitters 8, 10.

The device and the method of the invention ensure that only the required functions of the industrial truck are disabled. The deactivation of all of the above-mentioned functions of the industrial truck is necessary only in one of the cases indicated above.

The invention also teaches that it is possible to provide a signal transmitter 8 that, just when the driver's platform 6 passes the specified height H during a vertical movement, generates a pulse-type signal that contains no information about the direction of movement of the driver's platform 6. To thereby be able to determine whether the platform is below or above the specified level, additional measures are necessary. For example, a memory element or a sensor may be provided to detect the direction of movement. The same additional measures may be necessary if a signal transmitter 10 is provided that, when the blocking device 9 moves, generates a pulse-type signal that does not contain any information about whether the blocking device 9 was opened or closed.

It will readily be appreciated by those skilled in the art that modifications may be made to the invention without departing from the concepts disclosed in the foregoing description. Such modifications are to be considered as included within the scope of the invention. Accordingly, the particular embodiments described in detail hereinabove are illustrative only and are not limiting as to the scope of the invention, which is to be given the full breadth of the appended claims and any and all equivalents thereof.

What is claimed is:

1. An industrial truck, comprising:

a forward propulsion unit for forward and reverse movement of the industrial truck;

a driver's platform that is raised or lowered by a vertical propulsion unit;

at least one control device to control the vertical propulsion unit and the forward propulsion unit; and at least one blocking device that is adjusted to close or open an entrance to the driver's platform, wherein the control device is configured such that, as a function of an elevation of the driver's platform and a position of the blocking device, the control device operates as follows: either the forward propulsion unit and the vertical propulsion unit are enabled, or the forward propulsion unit and the vertical propulsion unit are disabled, or raising of the driver's platform is disabled while lowering of the driver's platform or forward and reverse movement of the industrial truck are enabled, wherein the control device is configured such that during a raising of the driver's platform with the blocking device open, when a specified level of the platform is reached, further elevation of the driver's platform is disabled, although lowering of the driver's platform or forward and reverse movement of the industrial truck are enabled, and wherein the control device is configured such that when the blocking device is opened, if the driver's platform is above a specified level, a vertical movement of the driver's platform as well as forward and reverse movement of the industrial truck are disabled.

2. The industrial truck as claimed in claim 1, including a first signal transmitter connected with the control device, wherein an output signal of the first signal transmitter changes as a function of the elevation of the driver's platform above or below a specified level.

3. The industrial truck as claimed in claim 2, including a second signal transmitter connected with he control device, wherein an output signal of the second signal transmitter changes as a function of the position of the blocking device.

4. The industrial truck as claimed in claim 3, wherein the control device is configured such that when the output signal of one of the two signal transmitters changes, the control device automatically checks the control signal of the other signal transmitter.

5. The industrial truck as claimed in claim 1, including a second signal transmitter connected with the control device, wherein an output signal of the second signal transmitter changes as a function of the position of the blocking device.

* * * * *

UNITED STATES PATENT AND TRADEMARK OFFICE

CERTIFICATE OF CORRECTION

PATENT NO. : 6,345,694 B1
DATED : February 12, 2002
INVENTOR(S) : Haspel Volker

It is certified that error appears in the above-identified patent and that said Letters Patent is hereby corrected as shown below:

Column 6,
Line 16, “with he” should read -- with the --.

Signed and Sealed this

Eleventh Day of June, 2002

*Attest:*

*Attesting Officer*

JAMES E. ROGAN
*Director of the United States Patent and Trademark Office*